US006669450B2

(12) United States Patent
Jeong

(10) Patent No.: US 6,669,450 B2
(45) Date of Patent: Dec. 30, 2003

(54) ROTARY SLANT SHAFT TYPE GAS COMPRESSOR WITH MULTI-STEPPED EXHAUST SYSTEM

(75) Inventor: Kyu-Ok Jeong, Kimhae (KR)

(73) Assignee: Airzen Co., Ltd., Kimhae (KR)

( * ) Notice: Subject to any disclaimer, the term of this patent is extended or adjusted under 35 U.S.C. 154(b) by 18 days.

(21) Appl. No.: 10/168,233

(22) PCT Filed: Oct. 18, 2001

(86) PCT No.: PCT/KR01/01760

§ 371 (c)(1),
(2), (4) Date: Jun. 18, 2002

(87) PCT Pub. No.: WO02/35094

PCT Pub. Date: May 2, 2002

(65) Prior Publication Data

US 2002/0192084 A1 Dec. 19, 2002

(30) Foreign Application Priority Data

Oct. 28, 2000 (KR) ..... 2000-63798
Jul. 19, 2001 (KR) ..... 2001-43553

(51) Int. Cl.[7] ..... F04B 1/12; F04B 27/08
(52) U.S. Cl. ..... 417/269; 91/499; 92/57
(58) Field of Search ..... 417/269; 91/485, 91/486, 487, 489, 499, 197, 503; 92/66.71, 57

(56) References Cited

U.S. PATENT DOCUMENTS 1,866,398 A 7/1932 Craig
3,228,303 A * 1/1966 Budzich ..... 91/198
3,656,299 A * 4/1972 Fleury ..... 60/53 A
4,756,236 A * 7/1988 Kanamaru et al. ..... 91/487

FOREIGN PATENT DOCUMENTS

EP 0 175 206 A1 * 3/1986
JP 61065081 3/1986

* cited by examiner

*Primary Examiner*—Justine R. Yu
*Assistant Examiner*—Han L Liu
(74) *Attorney, Agent, or Firm*—Alston & Bird LLP

(57) ABSTRACT

A rotary slant shaft type gas compressor having a multi-stepped exhaust system is provided, which includes: a driving shaft fixed with a cylinder head formed with gas holes; a gas guide member for intake of gas and discharge of compressed gas; a case head member coupled with the driving shaft and formed with an intake port and three exhaust ports; a valve plate member fixed on an inner surface of the case head member to contact an outer surface of the cylinder head, and formed with a gas intake valve groove and three gas exhaust valve grooves; a cylinder block formed with cylinder bores, integrally coupled with the cylinder head, and slidably inserted by pistons; and a swivel plate member connected to the cylinder block and the pistons and converting the rotation force to reciprocation motion.

22 Claims, 13 Drawing Sheets

ROTARY SLANT SHAFT TYPE GAS COMPRESSOR WITH MULTI-STEPPED EXHAUST SYSTEM

BACKGROUND OF THE INVENTION (a) Field of the Invention

The present invention relates to gas compressors, and more particularly to a rotary slant shaft type gas compressor having a multi-stepped exhaust system for selectively exhausting gas compressed in a cylinder according to a pressure of an exhaust channel.

(b) Description of the Related Art

A compressor is a machine for increasing a pressure and a potential speed of a medium by applying power from the outside. Such compressors are called fluid compressors since a fluid is an object of the compressor regardless of the state of the medium being compressed. As the media which may be compressed by the compressor, there are gasses such as air, nitrogen, oxygen and the like, and liquids such as oils or refrigerants. Even though a compressor to be described hereinafter may be used for compressing liquids such as oil, a gas compressor that compresses gasses such as air will be principally described.

As a publicly known gas compressor, there is a reciprocating compressor that compresses gas with a piston that carries out a simple reciprocation motion.

In general, the reciprocating compressor is formed with a cylinder, a piston reciprocating in the cylinder, and a cylinder head comprising an intake valve and an exhaust valve at an end of the cylinder, like an engine of a vehicle. In such a reciprocating compressor, intake, compression and exhaust of gasses are carried out while opening and closing the intake valve and the exhaust valve according to a gas pressure in the cylinder as the piston rectilinearly reciprocates in the cylinder.

This reciprocating compressor has, however, a disadvantage in that the intake valve and the exhaust valve mounted in the cylinder head directly contact the cylinder head or the piston during the gas compression stroke. The collision of the valves primarily induces mechanical noise, and bending or damage of the valves occurs in long-term use. Further, the reciprocating compressor has disadvantages in that a pulsation phenomenon is generated in the case of gas compression since the intake and the exhaust of gas occurs alternately in the cylinder, and that friction noise is generated by the instant expansion of the gas when opening or closing the valves.

An intake/exhaust muffler is provided to resolve the noise problem of the reciprocating compressor. However, if a muffler is mounted on the reciprocating compressor, the compressor itself becomes complicated mechanically and the number of required parts increases. Further, the gas resistance is increased due to the mounting of the muffler, thereby degrading performance of the compressor.

A slant shaft type compressor is disclosed as another gas compressor in Japanese Laying-open Publication No. 61-65081 (Apr. 3, 1986).

In the compressor disclosed in the publication No. 61-65081, rotation force of a rotation shaft is transmitted to a swivel plate, which is connected to pistons, for converting the rotation motion to a rectilinear reciprocation motion. In the compressor, a cylinder block formed with six cylinders is fixed to the rotation shaft and respective cylinders in the cylinder block are formed in a structure such that a surface facing a piston is open. The open cylinder is closed by a float valve formed with an intake/exhaust hole and a compressor case head contacts a rear surface of the float valve. A rubber ring is interposed between the float valve and the case head for preventing leakage of gas compressed in the respective cylinders.

In this compressor, if a driving shaft is rotated by rotation force transmitted from an external power supply, the cylinder block fixed to the driving shaft rotates together with the driving shaft, and the swivel plate connected to an end of the driving shaft rotates in response to the rotation of the driving shaft, so that the respective pistons rectilinearly reciprocate in the respective cylinders, in sequence.

According to the characteristics of this compressor, the respective cylinders rotate as being opened while the float valve and the case head do not move. The respective cylinders take in the gas through the intake hole of the float valve for gradually compressing the gas while rotating, and exhaust the compressed gas through the exhaust hole of the float valve toward a gas channel formed in the case head. In the above compression stroke, the float valve moves close to the cylinder block by a difference of gas pressures applied to a sectional area of the cylinder and a sectional area of the valve.

Comparing the compressor disclosed in the publication No. 61-65081 with the prior art reciprocating compressor, the piston of the compressor of 61-60851 reciprocates in parallel with the driving shaft direction, thereby allowing the manufacture of the compressor to be compact. Further, the compressor of 61-65081 does not employ reciprocating intake/exhaust valves but a fixed float valve, so that the mechanical noise caused by the direct collision between the valves and the cylinder head may be completely prevented. Furthermore, the compressor of 61-65081 exhibits compression efficiency and noise characteristics due to the gas pressure difference equal to the prior art reciprocating compressor in the case of continuous operation under a rated load.

In spite of the advantages described above, the compressor of 61-656081 has a serious disadvantage in that the cylinder block has to rub the float valve to maintain the seal between the rotating cylinder block and the stationary float valve, thereby causing abrasion of parts due to the continuous friction therebetween. In order to remove friction heat generated by the friction, the gas to be compressed has to be lubricative. Therefore, the gasses compressed in the compressor are limited to those having the lubrication property.

Further, the compressor has a disadvantage in that additional parts for emitting heat to the inside or the outside or absorbing the heat is needed, since the compression heat generated in the process of the compression of the gas in addition to the friction heat is very high. However, the compressor of 61-65081 does not suggest any heat removal parts, so durability of the compressor is degraded and gas compression efficiency is decreased by the various heat generated in actual use.

Considering the compressor of 61-65081 aerodynamically in view of the structure of the compressor, the compressor has a very big difference between a maximum pressure (Pm) in a compression section and an exhaust pressure (Pd) in an exhaust section. In this case, as the pressure difference between the two sections becomes larger, the aerodynamic noise generated when compression gas of a high pressure is discharged to a low pressure state becomes larger. Considering the compressor of 61-65081 with the prior art compressor on this issue, the compressor of 61-65081 exhibits a larger aerodynamic noise than the prior art reciprocating compressor due to such a big pressure difference.

Considering a compression load in the cylinder generated during operation, the compressor of 61-65081 exhibits a change width of the compression load per a unit time period much larger than that of the prior art reciprocating compressor. As the change of the compression load in the cylinder becomes larger, an axial force load applied to the driving shaft becomes larger. Therefore, in the compressor of 61-65081, the axial force load which is proportional to the compression load is applied to the swivel plate connected to the end of the driving shaft, directly influencing ball bearing parts mounted between a lower part of the swivel plate and the case, thereby degrading the durability of the compressor itself.

As described above, the compressor of 61-65081 has problems caused by the structure in spite of the various advantages over the prior art reciprocating compressor, so the compressor has a commercial limitation as a gas compressor.

Therefore, the demands for a new compressor of a structure that may maintain the basic characteristics of the slant shaft type gas compressor but resolves the disadvantages of the compressor of 61-65081 to minimize the aerodynamic noise, improve the durability of parts and accessories, increase the energy efficiency, minimize the number of required parts, and achieve loadless operation are increased together with demands for diversifying of the gasses to compress.

SUMMARY OF THE INVENTION

The present invention is derived to resolve the above problems of the prior art, and it has an object to provide a rotary slant shaft type gas compressor for discharging gas compressed in cylinder bores, not at once, but selectively in association with an external pressure.

It is another object of the present invention to provide a rotary slant shaft type gas compressor with a structure that may be designed aerodynamically for minimizing the noise mechanically and aerodynamically.

It is a further object of the present invention to provide a rotary slant shaft type gas compressor in which power required for compressing gas may be minimized to maximize the energy efficiency.

It is a still another object of the present invention to provide a rotary slant shaft type gas compressor in which a change of a compression load per unit time period may be minimized for improving the durability.

It is a still further object of the present invention to provide a rotary slant shaft type gas compressor in which gas to be taken into respective cylinder bores is first circulated through a crank chamber and then introduced into the cylinder bores.

It is a still another object of the present invention to provide a rotary slant shaft type gas compressor capable of operating loadlessly with a high efficiency.

It is a still another object of the present invention to provide a rotary slant shaft type gas compressor in which friction heat generated inside and compression heat generated by air compression may be effectively emitted.

In order to achieve the above objects of the present invention, a rotary slant shaft type gas compressor includes a valve plate contacting a rotating cylinder head and formed with an intake groove and a plurality of exhaust grooves, wherein the valve plate is fixed to a case head for selectively discharging gas compressed in cylinder bores.

In more detail, the rotary slant shaft type gas compressor includes: a driving shaft integrally formed with a cylinder head perpendicular to a driving shaft axis, the cylinder head being formed with a plurality of gas holes on a concentric circle at uniform intervals; a gas guide member formed with an intake manifold for intake of gas from the outside and an exhaust manifold for discharging gas compressed in cylinder bores to the outside; a case head member for rotatably supporting the driving shaft formed with at least one intake port for supplying the gas taken in through the intake manifold to the inside of the cylinder bores, and two or more exhaust ports for discharging the gas compressed in the cylinder bores to the exhaust manifold; a valve plate member fixed on an inner surface of the case head member to contact an outer surface of the cylinder head, and formed with a gas intake valve groove and at least two gas exhaust valve grooves on a periphery on which the gas holes move, the gas intake valve groove supplying the gas taken in through the intake port to the inside of the cylinder bores and the gas exhaust valve grooves discharging the gas compressed in the cylinder bores to the exhaust ports; a cylinder block formed with a plurality of cylinder bores in parallel with the driving shaft and having a surface integrally coupled with the cylinder head, and having an opposite surface slidably inserted with pistons in respective cylinder bores for compressing the intake gas in the respective cylinder bores; a swivel plate member connected to a center part of the cylinder block with a coupling, and connected to the plurality of pistons via piston rods, for converting the rotation force transmitted from the driving shaft to rectilinear reciprocation motion to be transmitted to the pistons; a case end plate formed with a slant surface for supporting the swivel plate member; and a case coupled with the case head member and the case end plate for incorporating the cylinder block and the swivel plate member.

In the rotary slant shaft type gas compressor of the present invention, the respective exhaust ports of the case head member incorporate respective check valves for selectively discharging the compressed gas via the respective exhaust grooves of the valve plate member according to an internal pressure of a compression tank.

The case head member and the driving shaft are formed with a circulation circuit for introducing the gas introduced from the intake manifold to the cylinder bores via a sealed crank chamber formed inside the case, so that aerodynamic noise possibly generated when compressed air remaining in the cylinder bores after an exhaust stroke is finished is met to new intake gas may be limited in the case, thereby minimizing the noise.

Further, a tension ring and a ring-shaped plate spring are inserted between an inner surface of the case head member and the valve plate member, so that the gap possibly generated by the friction between the valve plate and the cylinder head for a long term use may be completely prevented.

The rotating cylinder block and the swivel plate member are connected by a universal coupling or a spring coupling, so that the mechanical noise generated while the operation of the compressor may be minimized.

DETAILED DESCRIPTION OF THE PREFERRED EMBODIMENTS

Reference will now be made in detail to preferred embodiments and modifications of the present invention, examples of which are illustrated in the accompanying drawings.

Figure 1:
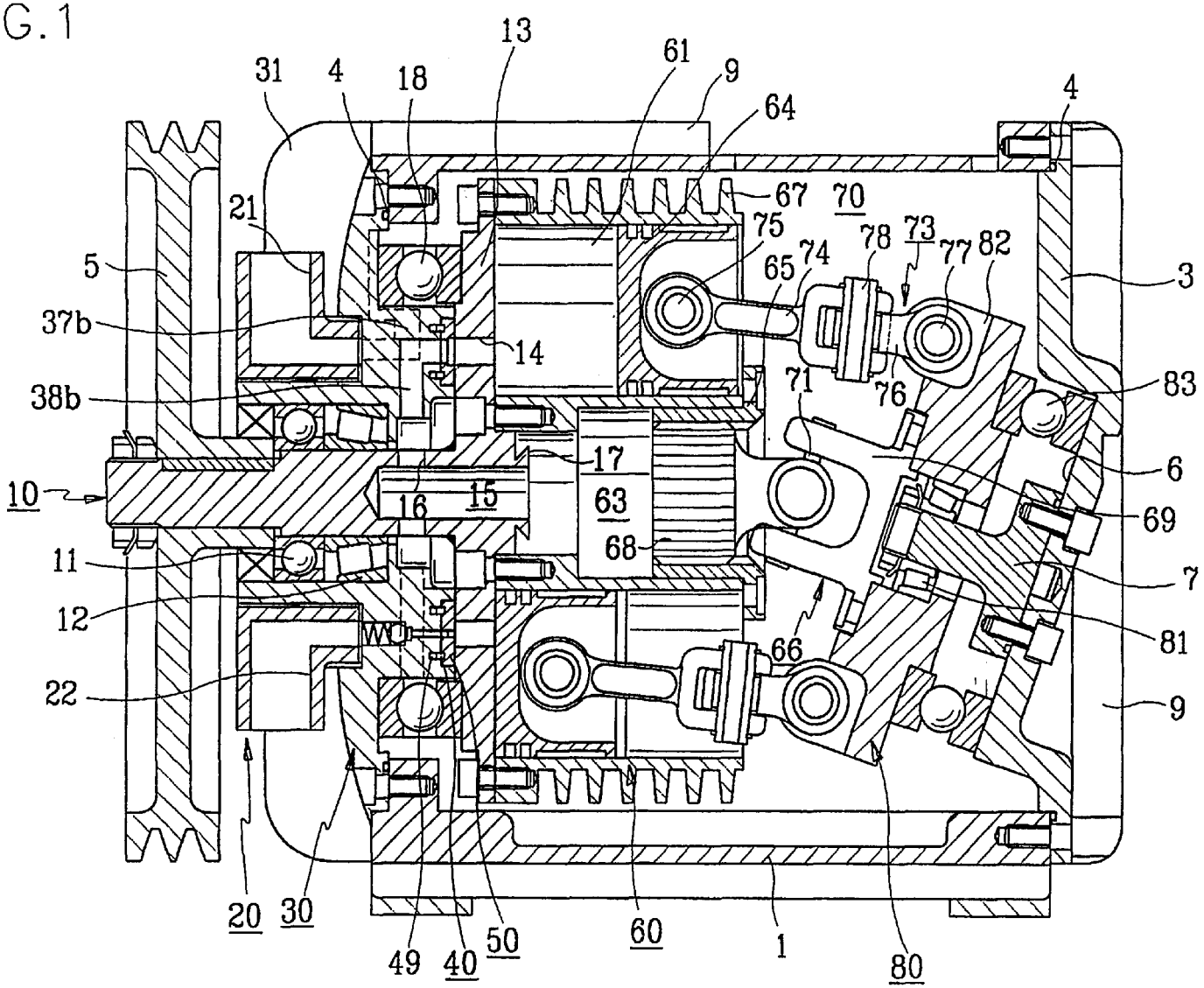
FIG. 1 is a cross-sectional view of a rotary slant shaft type gas compressor according to the present invention.

As shown in FIG. 1, main parts of a rotary slant shaft type gas compressor according to the present invention are housed in a cylindrical case 1. The case 1 is fixed with a case head 30 and a case end plate 3 at opposite side surfaces by bolts, and rubber rings 4 are inserted into each coupling surface of case parts 1, 30 and 3, so that a crank chamber 70 in the case is sealed from the outside.

The gas compressor received in the case 1 includes: a driving shaft 10 for transmitting the rotation force supplied from an external power supply to a swivel plate; a gas guide member 20 for intake and exhaust of gas from or to the outside; a case head member 30 for supplying the intake gas to a cylinder and selectively exhausting compressed gas according to a pressure of a compression tank; a valve plate member 50 fixed on an inner surface of the case head member for supplying gas into the rotating cylinder and exhausting the compressed gas; a cylinder block 60 incorporating a plurality of pistons for compressing the gas; and a swivel plate member 80 for converting the rotation motion of the driving shaft to rectilinear reciprocating motion.

The driving shaft 10 is extended as a central axis of the case 1 and is rotatably fixed to a boss part of the case head 30 by a ball bearing 11 and a taper roller bearing 12.

The driving shaft 10 has an end fixed with a driving pulley 5 transmitting the rotation force generated from the external power supply (not shown) to the driving shaft 10, and the other end is integrally formed with a cylinder head 13 for sealing cylinder bores 61 of the cylinder block 60. The cylinder head 13 is integrated with the driving shaft and is formed in the shape of a circular disc, and it has six gas holes 14 formed concentrically with the driving shaft at uniform intervals.

The driving shaft 10 is formed with a shaft chamber 15 inside it and with axial ports 16 perpendicular to the shaft direction for serving as flow channels to supply the gas introduced into the crank chamber 70 to the cylinder bores 61.

In the driving shaft, an end where the shaft chamber 15 is formed has a liquid introduction preventing shoulder 17, so that dispersed lubrication oil which may flow along a side surface of a block chamber 63 of the rotating cylinder block is prevented from being introduced into the cylinder bores 61.

Figure 2:
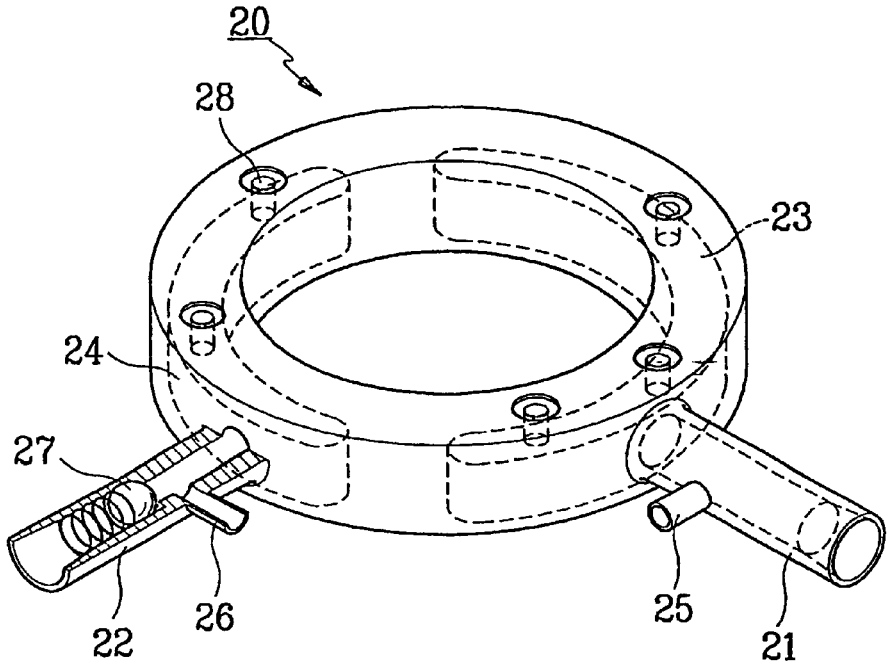
FIG. 2 is a perspective view of a gas guide member of the gas compressor according to the present invention.

The gas guide member 20 is formed cylindrically as shown in FIG. 1 and FIG. 2, and is fixed with an intake tube 21 and an exhaust tube 22 on its cylindrical body. The intake tube 21 serves to introduce gas to be compressed into the compressor and is attached with a filter (not shown) at an outside. The exhaust tube 22 serves to discharge the gas compressed in the compressor to the compression tank (not shown) as a storage tank, as it is communicated with the compression tank. The exhaust tube 22 incorporates a check valve 27 therein for preventing the compressed gas in the compression tank from flowing back to the inside of the cylinder bores. The gas guide 20 is formed with an intake manifold 23 communicated with the intake tube 21, and an exhaust manifold 24 communicated with the exhaust tube 22 on a same circumference in a bottom surface thereof. The intake tube 21 and the exhaust tube 22 are attached to an auxiliary intake tube 25 and an auxiliary exhaust tube 26 respectively on a side surface, such that the auxiliary intake tube 25 and the auxiliary exhaust tube 26 are connected to each other for minimizing a load of the compressor without stopping the operation thereof when compression of the gas is no longer necessary.

Such an intake compression stroke as alluded to above is called loadless operation. In such a loadless operation state, the pressure compressed in the compression tank is prevented from flowing back to the exhaust tube 22 by the check valve 27 incorporated in the exhaust tube. Reference number 28 represents bolt holes for closely contacting and fixing the gas guide to the case head 30 by bolts.

The case head 30 is, as shown in FIG. 1 and FIG. 3, formed with heat emission fins 31 and guide grooves 32 for fixing the gas guide member on an outer surface thereof, and mounting grooves 33 for mounting a thrust bearing 18 for uniformly maintaining a gap from the cylinder head 13, plate grooves 34 for fixing the valve plate 50, and a ring groove 35 for inserting a tension ring 40 which contacts the valve plate with the cylinder head on an inner surface thereof. The case head 30 is formed with a boss part 36 for receiving the ball bearing 11 and the taper roller bearing 12 to support the driving shaft 10 in a center thereof. The heat emission fins 31 formed on the outer surface of the case head 30 are arranged radially with respect to the driving shaft, so that cooling air flows smoothly to the outside by way of an external air fan (not shown). In order to improve the cooling effect, heat emission fins 9 are formed outside the case 1 in parallel with the driving shaft. The air fan for cooling the air is preferably mounted to the driving pulley 5.

The case head 30 serves as a flow channel for circulating the gas which is supplied from the gas guide member 20 into the crank chamber 70 to be taken into the cylinder bores 61 and selectively discharging the gas compressed in the cylinder to the outside. Therefore, the gas flow channel formed to the case head 30 serves an important role to achieve the object of the present invention. The gas flow channel of the case head 30 is mainly formed between the guide groove 32 and the plate groove 34 with separated intake and exhaust channels.

Figure 3A:
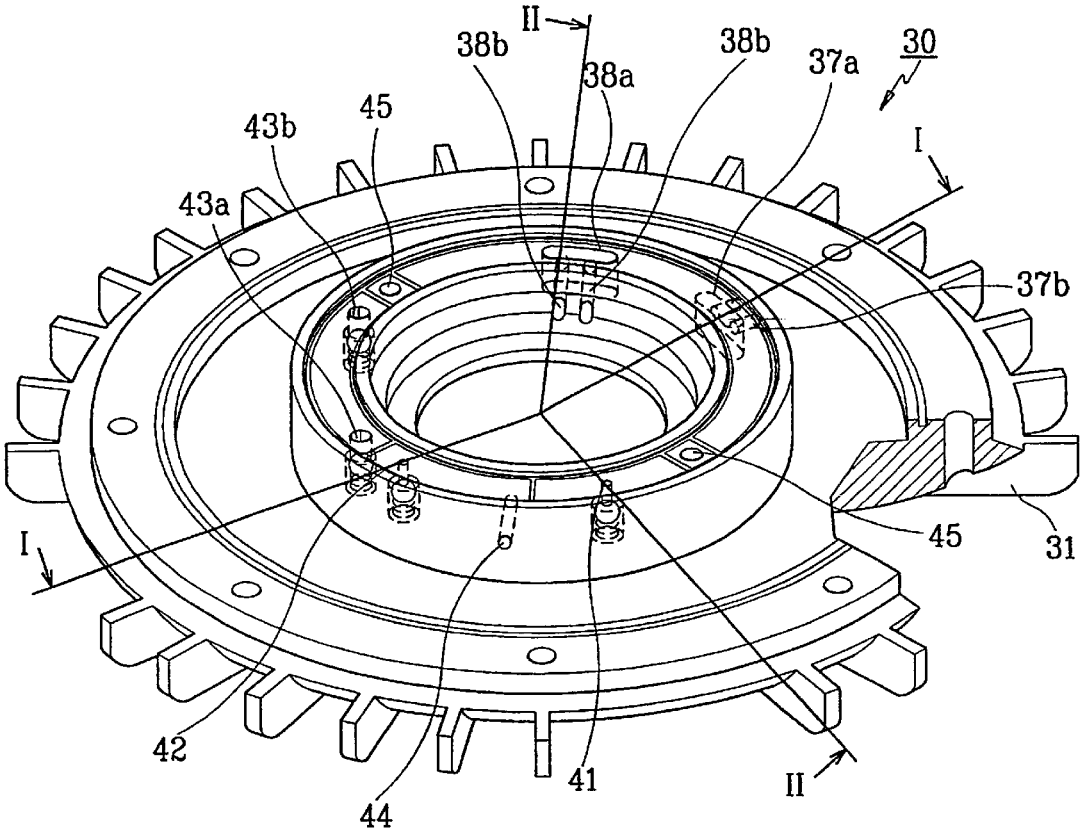
FIG. 3A is a perspective view of a case head of the gas compressor according to the present invention.
Figure 3B:
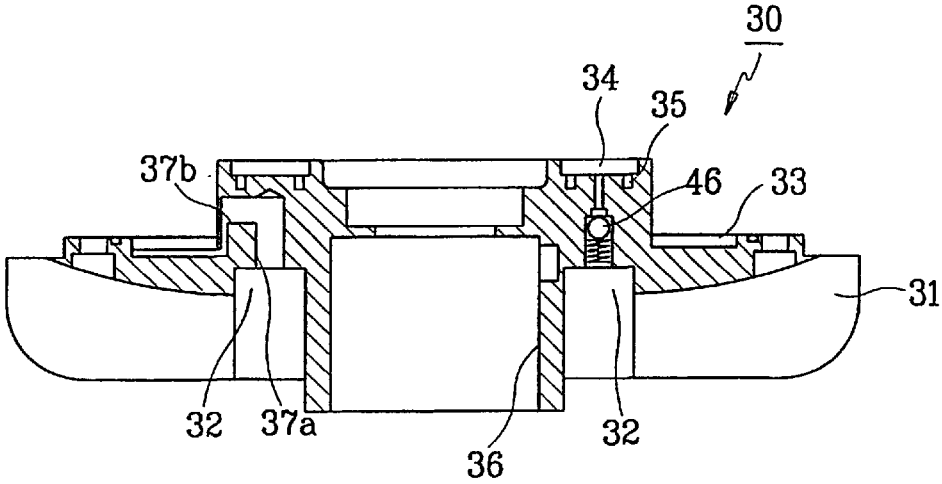
FIG. 3B is a cross-sectional view of the case head taken along the line I—I of FIG. 3A.
Figure 3C:
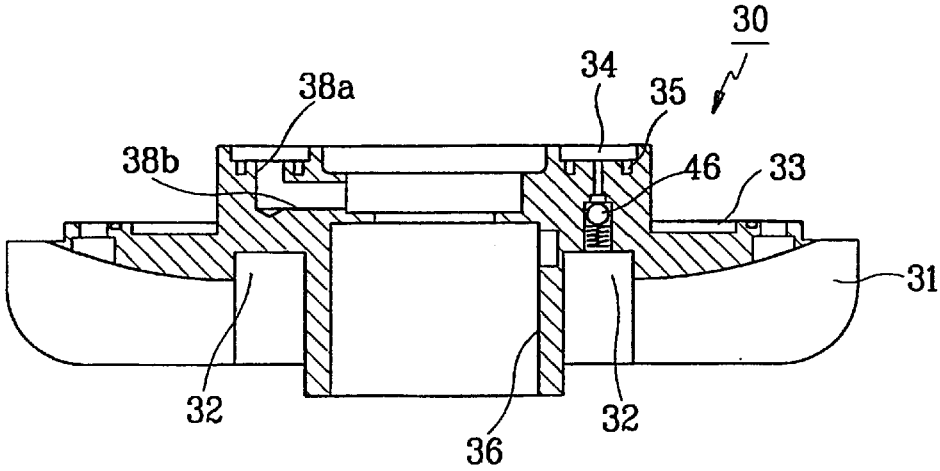
FIG. 3C is a cross-sectional view of the case head taken along the line II—II of FIG. 3A.

The gas intake channel is, as shown in FIG. 3, formed of a first intake port 37*a* and a second intake port 38*a*. The first intake port 37*a* (FIG. 3B) is communicated with the guide groove 32 at a side to be connected to the intake manifold 23 of the gas guide member and is connected to a side surface of the case head 30 by a side port 37*b* at the other side. The side port 37*b* is formed at a lower part of the mounting groove 33 to be secured by the thrust bearing 18, so that the intake gas is prevented from passing by the thrust bearing 18. The second intake port 38*a* (FIG. 3C) is communicated with the plate groove 34 at a side to face the cylinder bores 61 and is communicated with the driving shaft 10 by a side port 38*b* to face the axial port 16 of the driving shaft at the other side. According to the above gas intake channels, the gas supplied from the intake manifold 23 of the gas guide member is introduced into the first intake port 37*a* and the side port 37*b*, and is taken into the cylinder bores 61 via the side port 38*b* and the second intake port 38*a* after passing through the crank chamber 70, the block chamber 63 and the shaft chamber 15.

The gas exhaust channel is, as shown in FIG. 3A, formed of a first exhaust port 41, a second exhaust port 42 and third exhaust ports 43*a* and 43*b*, wherein the first to third exhaust ports 41, 42, 43*a* and 43*b* penetrate the case head 30 to be connected to the exhaust manifold 24 of the gas guide member. The respective exhaust ports 41, 42, 43*a* and 43*b* incorporate a check valve 46 for preventing the compression gas from flowing back into the cylinder bores 61 through the exhaust manifold 24. In FIG. 3A, reference number 44 represents a drain port for discharging lubrication oil which is taken in into the shaft chamber 15 to the crank chamber, and 45 represents bolt holes for fixing the valve plate 50 to the case head 30.

Figure 4:
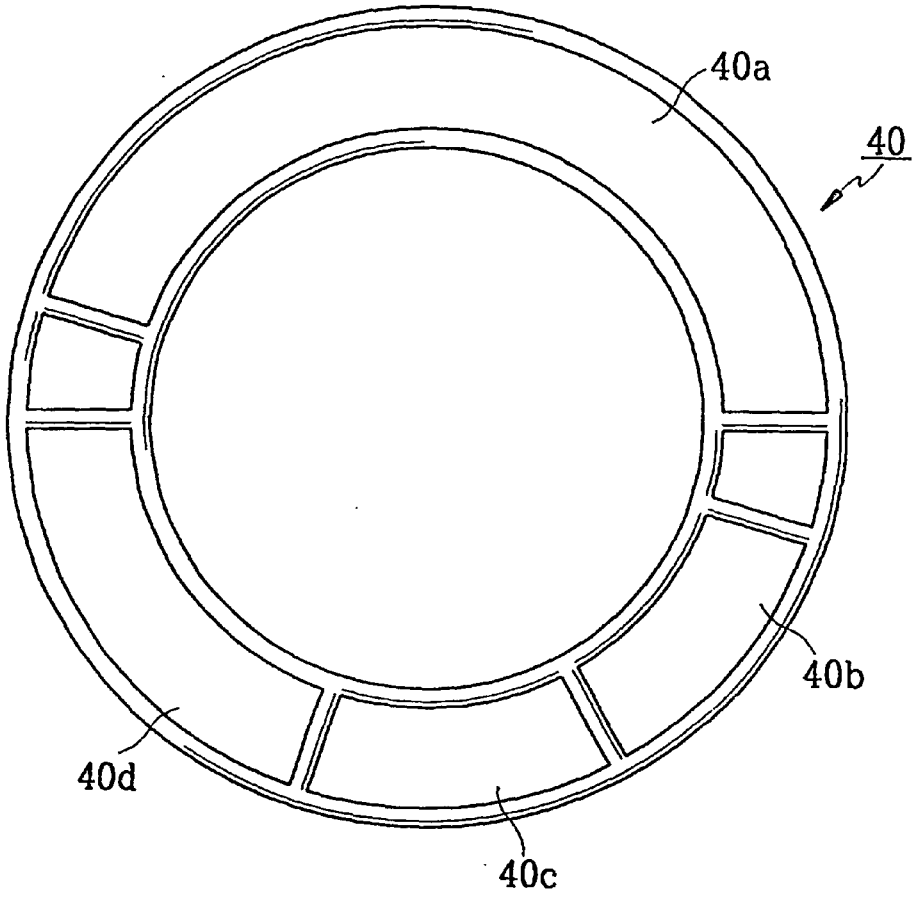
FIG. 4 is a perspective view of a tension ring of the gas compressor according to the present invention.

FIG. 4 shows the tension ring 40 to be inserted in the ring groove 35 of the case head. The ring groove 35 incorporates a circular plate type ring-shaped plate spring 49 (FIG. 1) for applying elasticity to the tension ring by the plate spring 49 for the tension ring 40 to press the valve plate 50 against the cylinder head 13.

The tension ring 40 inserted into the ring groove 35 prevents the leakage of gas to be compressed during the gas compression stroke and the introduction of impurities such as the cooling oil into the cylinder bores 61. The tension ring 40 is divided into an intake section 40*a* and first to third exhaust sections 40*b*, 40*c* and 40*d*, for preventing leakage of the gas to be compressed during the gas compression stroke from one section to another section. The tension ring 40 is formed of a material having heat-resistance and elasticity like a heat-resistant rubber or urethane.

Figure 5:
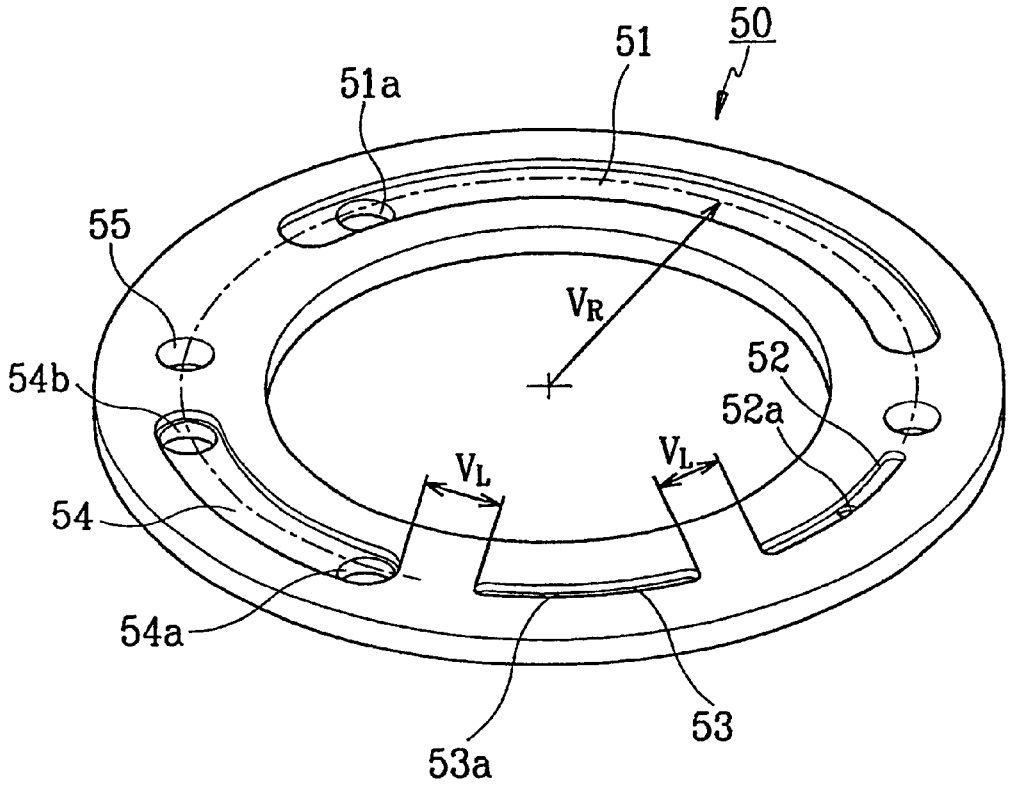
FIG. 5 is a perspective view of a valve plate of the gas compressor according to the present invention.

The valve plate member 50 is, as shown in FIG. 1 and FIG. 5, formed in the shape of a circular plate type ring, and has a top surface in contact with an outer surface of the cylinder head to carry out a sliding motion in association with the rotation of the cylinder head. The top surface of the valve plate member 50 is formed with a single intake valve groove 51 and separated first to third exhaust valve grooves 52, 53 and 54 on the top surface in the shape of an arc, wherein widths of the intake valve groove 51 and the third exhaust valve groove 54 are equal to or larger than a diameter of the gas holes 14 of the cylinder head, and widths of the first and second exhaust valve grooves 52 and 53 are smaller than the diameter of the gas holes.

Now, positions of the valve grooves 51, 52, 53 and 54 of the valve plate member 50 will be explained in more detail with reference to FIG. 5 and FIG. 9A. The intake valve groove 51 is positioned within a section of 180° of a circumference corresponding to an intake stroke section in which a specific piston moves from top dead center to bottom dead center, and the three gas exhaust valve grooves 52, 53 and 54 are formed in the remaining 180° section of the circumference corresponding to a compression stroke section in which the piston moves from bottom dead center to top dead center.

A radius VR of a circumference which connects each center line of the valve grooves 51, 52, 53 and 54 is equal to a radius HR of a circumference which connects six center lines of the gas holes 14 of the cylinder head, so that the respective gas holes 14 pass through the valve grooves 51, 52, 53 and 54 in sequence.

The gas intake valve groove 51 and the gas exhaust valve grooves 52, 53 and 54 of the valve plate member are formed apart from one another by at least a certain distance, that is, a length VL of a partition wall, wherein it is important to keep the distance larger than a diameter of the gas holes 14 of the cylinder head.

It is also important to form the respective lengths of the first to third exhaust valve grooves 52 to 54 smaller than a distance between the gas holes 14 so as not to position more than one gas hole 14 in one of the exhaust valve grooves 52 to 54.

The intake and first and second exhaust valve grooves 51 to 53 are respectively formed with valve holes 51*a* to 53*a* penetrating the valve plate 50, and the third exhaust valve groove 54 is formed with two valve holes 54*a* and 54*b*.

The intake valve hole 51*a* which penetrates the valve plate is connected to the second intake port 38*a* on the bottom surface of the case head, the first exhaust valve hole 52*a* is connected to the first exhaust port 41, the second exhaust valve hole 53*a* is connected to the second exhaust port 42, and the third exhaust valve holes 54*a* and 54*b* are connected to the third exhaust ports 43*a* and 43*b*. Therefore, the gas, which is introduced from the second intake port 38*a* of the case head into the intake valve groove 51 of the valve plate, is taken into the respective cylinder bores 61 via the gas holes 14 of the cylinder head rotating to be gradually compressed by the rotation of the cylinder block 60 and selectively discharged to the exhaust valve grooves 52 to 54 of the valve plate which meets the gas holes 14 according to the pressure of the compression tank. The compression gas introduced into the respective exhaust valve grooves 52 to 54 is respectively discharged via the exhaust valve holes 52*a*, 53*a*, 54*a* and 54*b* and the exhaust ports 41, 42, 43*a* and 43*b* to the exhaust manifold 24 of the gas guide member.

As shown in FIG. 1, the cylinder block 60 is formed in the shape of a cylinder on the whole, and it is formed with the block chamber 63 in the axial center of the cylinder block. Also, the cylinder block 60 is formed with the six cylinder bores 61 of an equal diameter radially adjacent to the block chamber 63 in a longitudinal direction of and parallel with the driving shaft.

The cylinder block 60 is coupled and sealed with the cylinder head 13 of the driving shaft by bolts at a sectional surface, and the respectively cylinder bores 61 are slidably inserted with six pistons 64. The block chamber 63 is fixed with a coupling 65 by a bolt for coupling to a universal coupling 66, which is explained hereinafter. The cylinder block 60 is formed with spiral heat emission fins 67 on an outer peripheral surface, wherein the heat emission fins 67 accelerate the circulation of the gas that flows through the space in the crank chamber, when the cylinder block 60 rotates. The heat emission fins 67 may also be formed in a plurality of circles apart from one another by a uniform interval in addition to the spiral shape. The block chamber 63 is formed in the shape of a cylinder of two stages having different diameters for preventing the dispersed lubrication oil from flowing toward the chamber 15.

The cylinder block 60 is connected to the swivel plate member 80 by the universal coupling 66 along central lines of rotations axis of respective parts, wherein the swivel plate member will be described below. The universal coupling 66 is formed of a driving joint 68 and a driven joint 69, wherein the driving joint and the driven joint are connected to each other by a cross shaft 71 at each fork-type arm part. The driving joint 68 of the universal coupling is hollow and has a cylindrical spline at an outer periphery to be spline-coupled with the coupling 65 that is fixed to the cylinder block 60, and the driven joint 69 is formed with a flange at an end to be coupled with the swivel plate member by bolts.

The swivel plate member 80 is axially coupled with a driven shaft 7 by way of a taper roller bearing 81 in the center of its rotation shaft, wherein the driven shaft 7 is fixed to a slant surface 6 of the case end plate 3 in the center of its rotation shaft. The swivel plate member 80 is formed with 6 pairs of brackets 82 on an outer periphery thereof, each pair of brackets to be coupled to one end of a piston rod 73, and it has a shoulder on the opposite surface to the brackets 82 to mount a thrust bearing 83 in a space between the slant surface 6 and the swivel plate member 80.

The six pistons 64 respectively inserted into the cylinder bores 61 are rotatably coupled with the brackets 82 of the swivel plate member by the piston rods 73. The piston rods 73 coupled between the respective pistons 64 and the swivel plate member 80 may be selected from a universal-coupling or a two-fold type crank. A piston rod 73 in the shape of the two-fold type crank is formed of a first rod 74 and a second rod 76. The first rod 74 is connected to the piston 64 by a connection pin 75 at one end and is formed with a fork arm at the other end. The second rod 76 is connected to the bracket 82 of the swivel plate member by a connection pin 77 at one end, and it is formed with a coupling hole at the other end. The first rod 74 and the second rod 76 are coupled by inserting a connection pin 78 through the fork arm of the first rod 74 and the coupling hole of the second rod 76 such that the rods 74 and 76 are rotatably fixed by the connection pin 78. At each connection point, bearings are coupled with outside the connection pins. The piston rod 73 in the shape of a universal coupling, which is not shown in the drawings, has a similar coupling structure as the piston rod in the shape of the twofold type crank, wherein both rods are rotatably fixed by the cross shaft.

FIGS. 6A through 6C and FIG. 7 show further embodiments of the present invention.

In the embodiments of the present invention, main parts which determine the driving mechanism of the present invention have the same functions, and various modifications are made with respect to the structure of the gas intake channel, the connection structure between the cylinder block 60 and the swivel plate member 80, and the cooling structure for cooling the gas compressor.

Figure 6A:
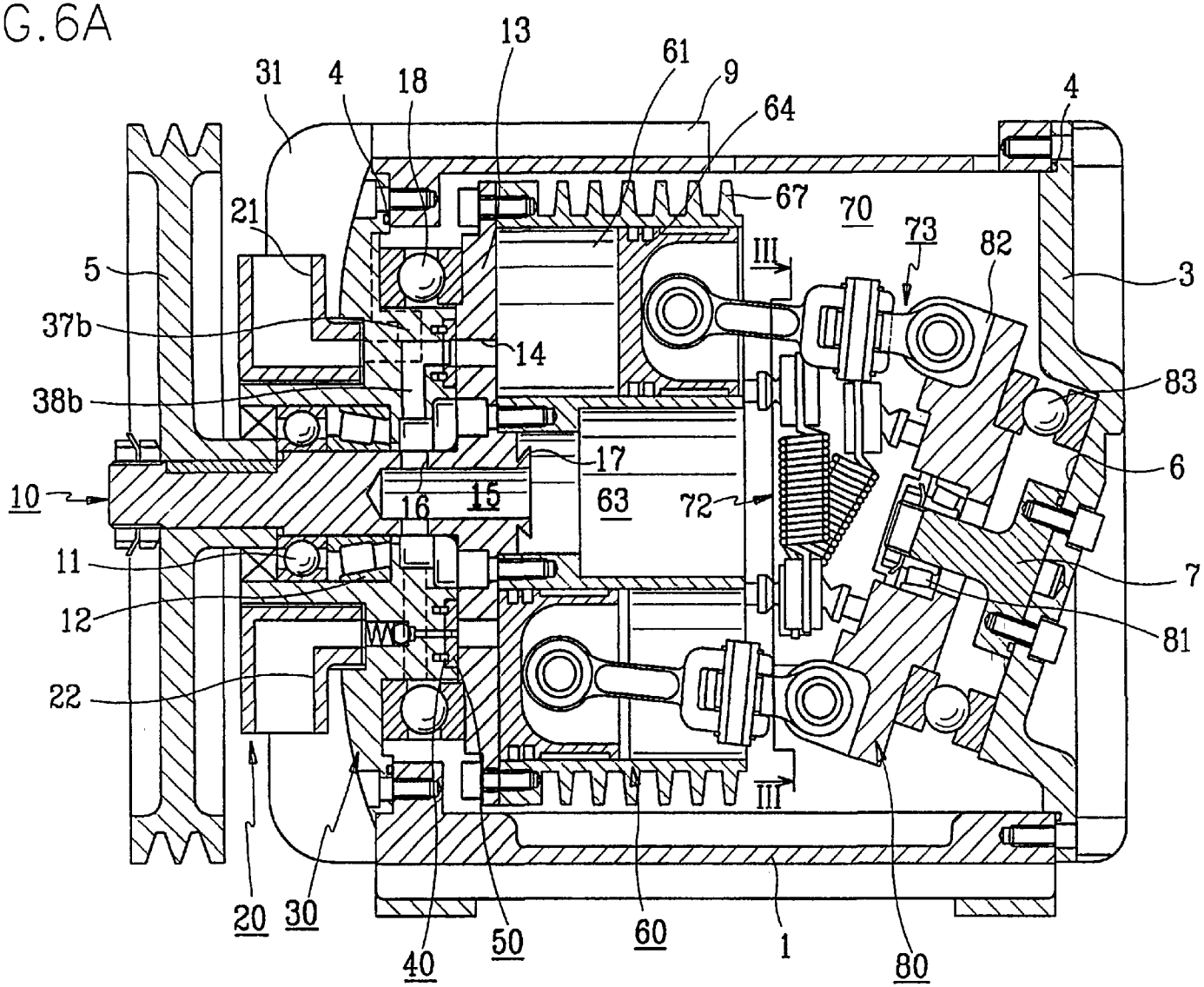
FIG. 6A is a cross-sectional view of a rotary slant shaft type gas compressor according to another preferred embodiment of the present invention.

The embodiment of the present invention as shown in FIG. 6 is basically equivalent to the embodiment of the present invention as shown in FIG. 1, except for the connection structure between the cylinder block 60 and the swivel plate element 80. In FIG. 6A, the piston rods 73 which connect the respective pistons 64 to the swivel plate member 80 are formed in the two-fold type crank shape as in the embodiment of FIG. 1, whereas the cylinder block 60 and the swivel plate member 80 are connected to each other not by the universal coupling but by a spring coupling 72. Therefore, the power of the driving shaft 10 is transmitted to the swivel plate member 80 not by the universal coupling but by the piston rods 73.

Figure 6B:
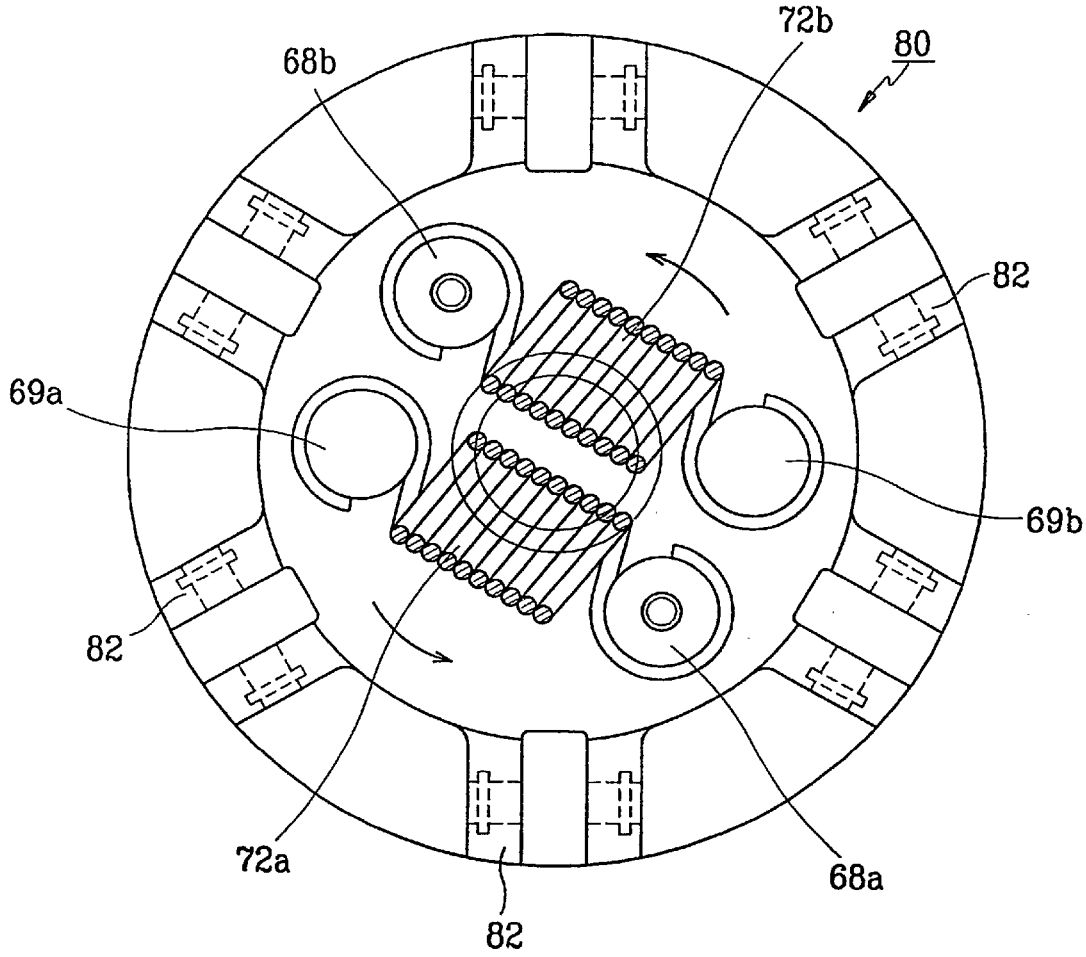
FIG. 6B is a cross-sectional view of the spring coupling of the gas compressor taken along line III—III of FIG. 6A.

The spring coupling 72 connects the cylinder block 60 to the swivel plate member 80 with two parallel springs 72*a* and 72*b* as shown in FIG. 6B. The cylinder block 60 is formed with two block rings 68*a*, 68*b* diagonally across from each other with respect to the springs 72*a* and 72*b*, and the swivel plate member 80 is formed with first and second swivel plate rings 69*a*, 69*b* also diagonally across from each other, so that the first spring 72*a* is coupled with the first block ring 68*a* and the first swivel plate ring 69*a*, and the second spring 72*b* is coupled with the second block ring 68*b* and the second swivel plate ring 69*b*. According to the coupling structure of the spring coupling 72, the cylinder block 60 and the swivel plate member 80 apply attraction force to each other in the same direction as the rotation of the cylinder block 60 and the piston rods 73, as shown by an arrow of FIG. 6B. The attraction force compensates the reaction force which is generated by the swivel plate member 80 when the cylinder block 60 begins to rotate, wherein the springs 72*a* and 72*b* of the spring coupling 72 respectively have a coefficient of elasticity determined in consideration of the reaction force of the swivel plate member 80. In the block rings 68*a* and 68*b* and the swivel plate rings 69*a* and 69*b*, holder parts in which fixing pins for fixing the respective rings are connected to the springs are connected by ball joints in consideration that the swivel plate member 80 carries out a swing motion when the gas compressor operates.

Figure 6C:
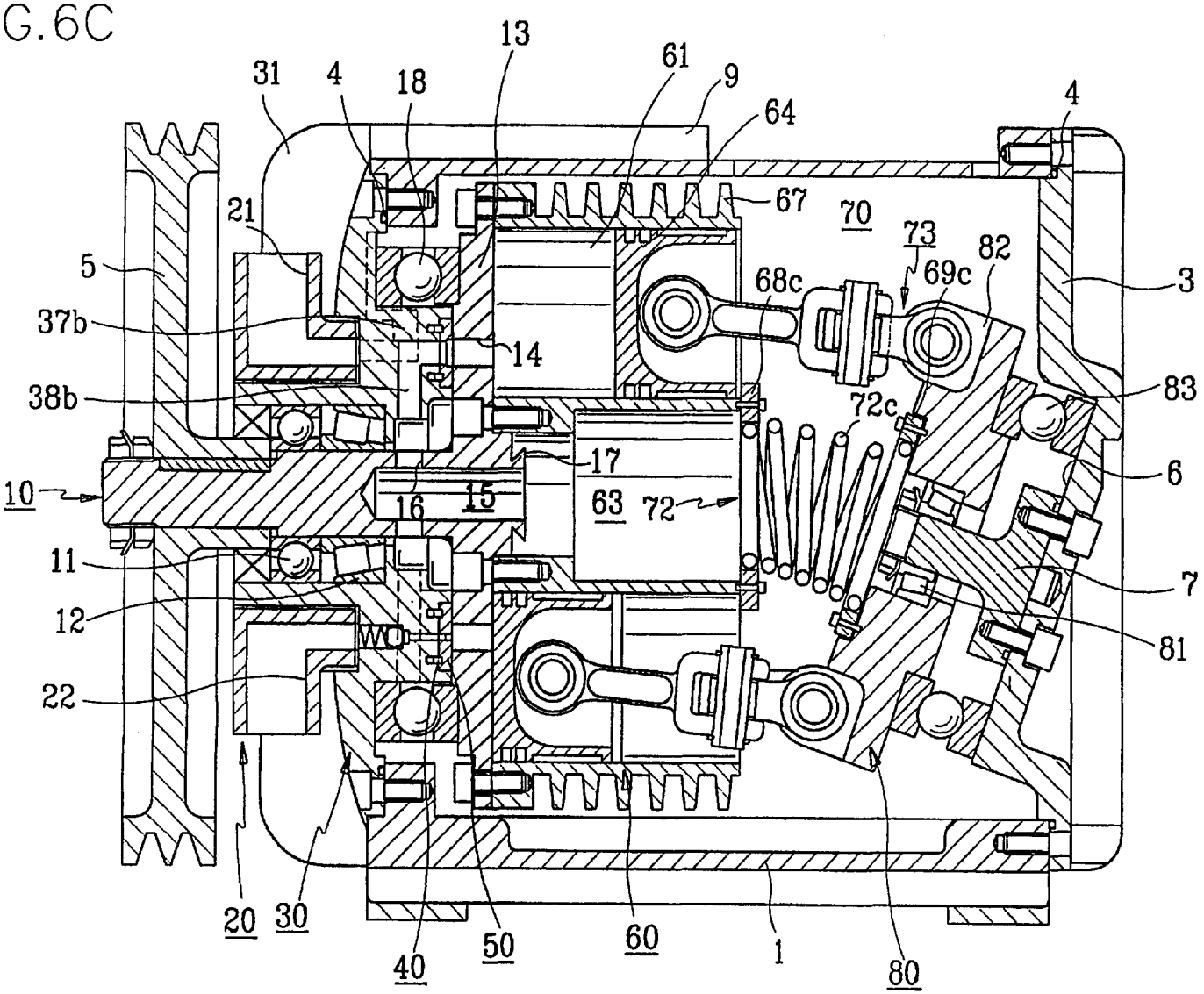
FIG. 6C is a cross-sectional view of a spring coupling according to another preferred embodiment of the present invention.

FIG. 6C shows a spring coupling 72 according to another embodiment of the present invention. In FIG. 6C, the spring coupling 72 is formed of a cylinder 72*c* of which ends are respectively coupled with a block flange 68*c* and a swivel plate flange 69*c*, and the block flange 68*c* and the swivel plate flange 69*c* are respectively fixed to the cylinder block 60 and the swivel plate member 80 by bolts. When coupling the cylindrical spring 72*c*, the cylindrical spring 72 is initially distorted by a predetermined amount in the same direction as the rotation of the cylinder block 60 and the piston rods 73. Therefore, the distortion stress of the spring 72 compensates the reaction stress generated by the swivel plate member 80 when the cylinder block 60 begins to rotate.

Figure 7:
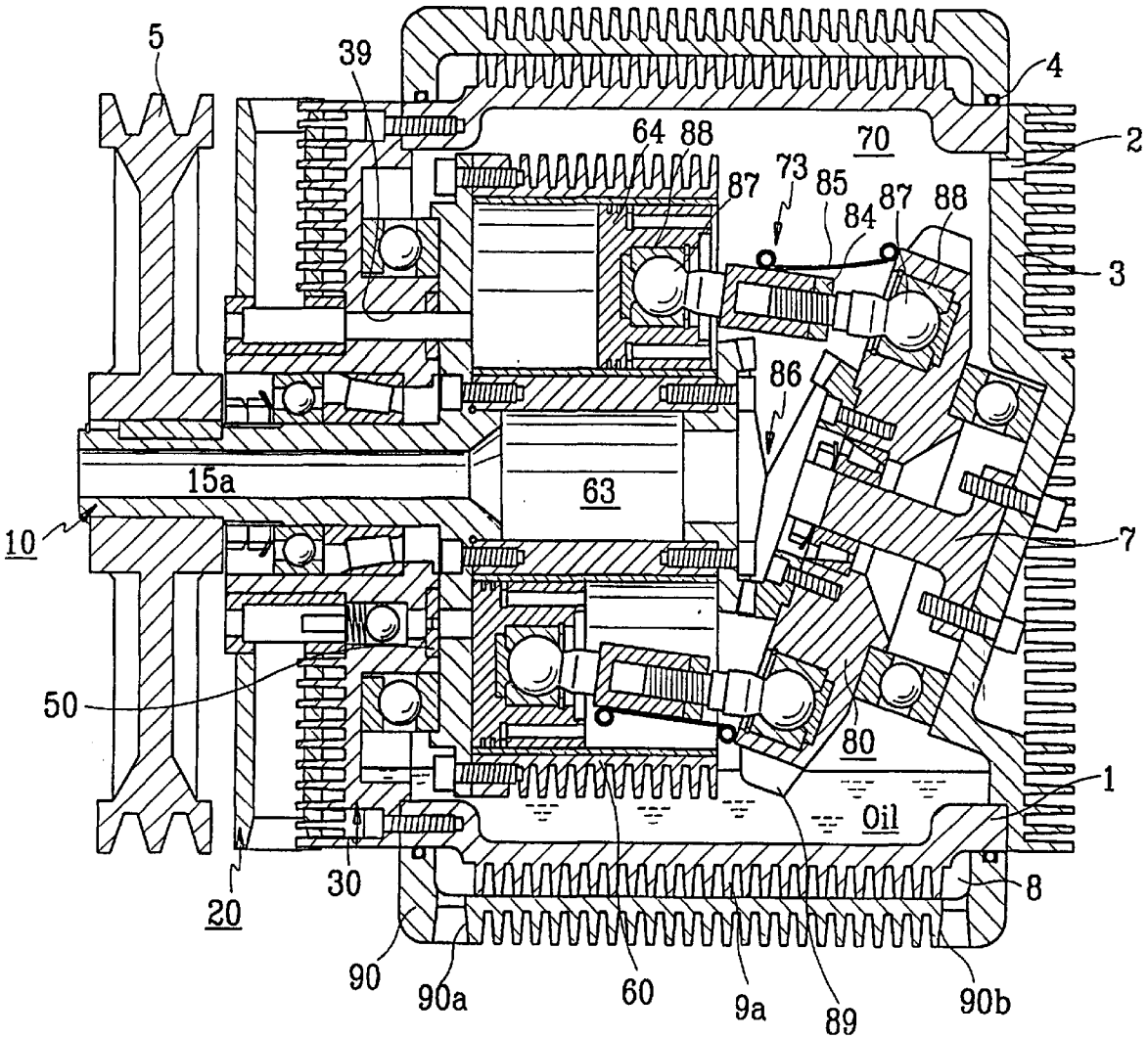
FIG. 7 is a cross-sectional view of a rotary slant shaft type gas compressor according to another preferred embodiment of the present invention.

Comparing the gas compressor as shown in FIG. 7 with that of FIG. 1, the structure of the gas intake channels, the connection structure between the cylinder block 60 and the swivel plate member 80, and the cooling structure for cooling the gas compressor are modified. Now, the main parts of the modified embodiment as above will be explained in detail.

The differences of the embodiment of FIG. 7 from that of FIG. 1 are as follows.

First, the driving shaft 10 is formed with a through hole 15*a* which completely penetrates the inside of the driving shaft, axially. In the case that the through hole 15*a* is formed in the driving shaft, the axial port 16 of FIG. 1 is omitted. The through hole 15*a* serves as a channel for discharging lubrication oil mist which is generated in the crank chamber 70 to the outside and as a cooling tube channel for introducing atmospheric air into the crank chamber 70, when the gas compressor using the lubrication oil is in operation.

Second, the intake port 39 of the case head member 30 is formed penetrating a portion between the guide groove 32 and the plate groove 34. Comparing the two embodiments of FIG. 1 and FIG. 7, the first and second intake ports 37*a* and 38*a* (shown in FIG. 3A), the side ports 37*b* and 38*b*, and the additional drain port 44 as shown in FIG. 3A are not formed in the case head 30 of FIG. 7. The direct penetration of the gas intake port 39 is to supply the gas introduced from the gas guide member to the inside of the cylinder bores 61 without circulating it inside the crank chamber 70.

Third, the cylinder block 60 and the swivel plate member 80 are coupled with two shafts by a bevel gear 86, improving the assembling performance.

Fourth, the pistons 64 and the swivel plate member 80 are connected to piston rods 73 in the shape of a two-fold type extension rod. By separately forming the piston rods in two parts in the shape of male and female bolts, a stroke clearance of the pistons may be finely controlled when assembling the pistons by using lock nuts 84. If the extension type rod is used for the piston rods 73 as shown in FIG. 7, a plate spring 85 is mounted outside the respective piston rods and on the outer peripheral surface of the swivel plate member 80. The plate spring 85 serves to compensate the centrifugal force applied to the pistons 64 when the cylinder block 60 rotates with the swivel plate member 80.

As shown in FIG. 7, if the extension rod type piston rods 73 are employed, it is preferable to operate the compressor by pouring the lubrication oil into a bottom part of the crank chamber 70. If the lubrication oil is poured into the bottom part of the crank chamber 70 for operating the compressor, the lubrication oil is dispersed into the chambers when the compressor is operating, thereby cooling friction heat that is generated between balls 87 of the extension rods and ball joints 88.

Fifth, the cylindrical case 1 is attached with a cooling case 90 surrounding the outside of the cylindrical case. Therefore, a cooling chamber 8 is formed between the case 1 and the cooling case 90. The cooling case 90 is formed with a coolant intake hole 90*a* and a coolant discharge hole 90*b*, and heat emission fins 9*a* are spirally formed outside the case 1 for channeling the coolant circulating in the cooling chamber 8 to the outside via the discharge hole 90*b* after it circulates over the outer peripheral surface of the case 1. The heat emission fins 9 and 9*a* are arranged spirally as shown in FIG. 7 for a liquid cooling system, and in parallel to the driving shaft 10 as shown in FIG. 1 for an air cooling system.

Finally, a plurality of blades 89 is formed on an outer peripheral surface of the swivel plate member 80 in the gas compressor as shown in FIG. 7. The blades 89 serve to disperse the lubrication oil from the bottom of the crank chamber 70 to the inside of the chamber in the compressor that uses the lubrication oil.

The above preferred embodiments and modifications thereof are explained with respect to the main parts required for operation and the coupling relationship therebetween. Explanation of the other parts such as case sealing parts, sliding balls, piston rods and the like of which structures are similar to those of general mechanical equipment will be omitted.

The axial coupling structure of the cylinder block 60 and the swivel plate member 80, the piston rods 73, and the cooling structure explained with reference to the preferred embodiments and modifications of the present invention are not limitedly used alone as in the respective corresponding embodiments, but may be used in combination selectively according to the usage of the gas compressor.

Now, the operation and the operational characteristics of the gas compressors according to the preferred embodiments and modifications of the present invention as described above will be explained in detail with reference to FIG. 8 to FIG. 10.

Figure 8:
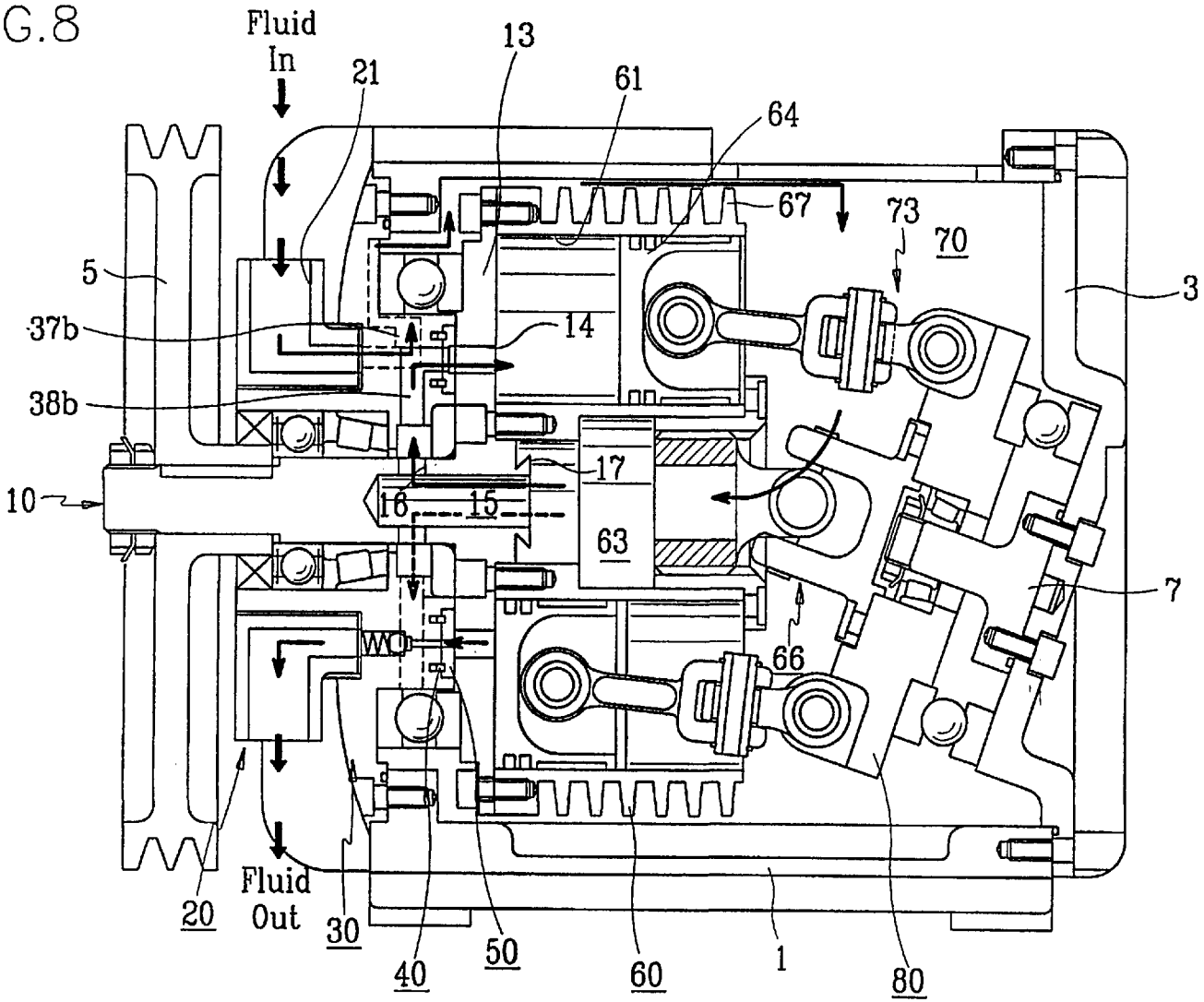
FIG. 8 is the cross-sectional view of FIG. 1, showing gas intake and exhaust process of the gas compressor.
Figure 9:
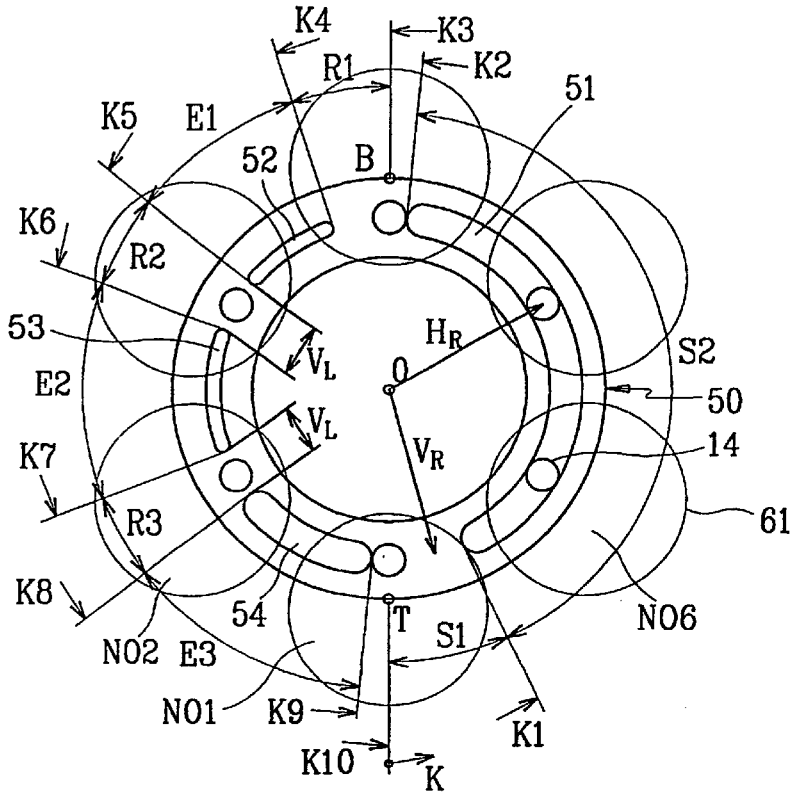
FIG. 9A is a view for explaining the gas intake, compression and exhaust strokes in the valve plate of the gas compressor according to the present invention.
FIG. 9B is a view for explaining the gas compression characteristics when cylinders rotate one cycle in the valve plate of the gas compressor according to the present invention.
Figure 9:
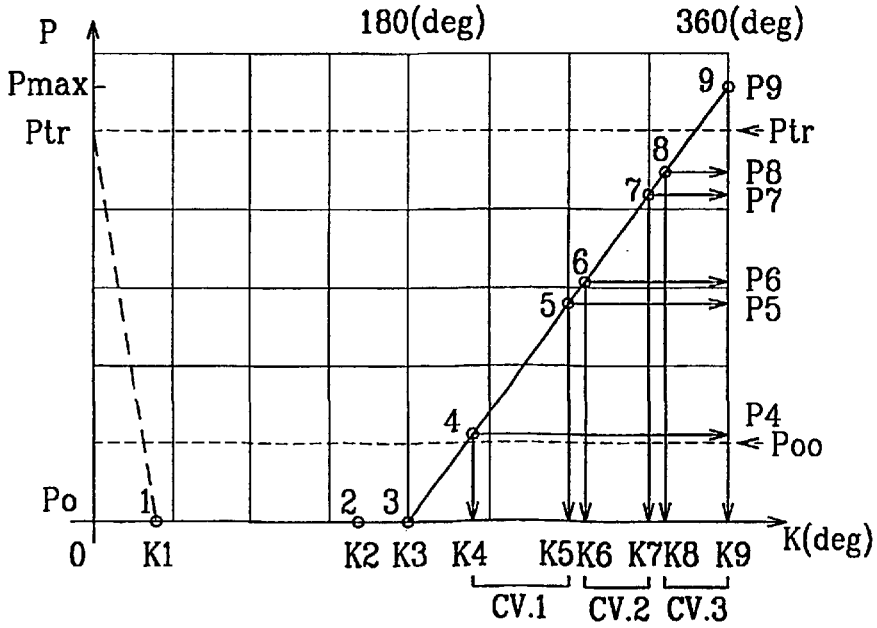

As shown in FIG. 8, the rotation force generated from the external power supply such as a motor (not shown) is transmitted to the pulley 5 via a power transmission element such as a belt (not shown). As the driving shaft 10 rotates by the rotation force transmitted to the pulley 5, the cylinder head 13 and the cylinder block 60 rotate together with the driving shaft 10. Simultaneously, the swivel plate member 80 coupled with the cylinder block 60 by the universal coupling 73 (or the spring coupling as shown in FIG. 6, or the bevel gear as shown in FIG. 7) rotates with respect to the driven shaft 7. As the swivel plate 80 swings in the direction inclined toward the driving shaft, the respective piston rods 73 coupled with the swivel plate member 80 reciprocate rectilinearly in the driving shaft direction.

The power of the driving shaft 10 in FIGS. 6A and 6C is transmitted to the swivel plate member 80 not by the spring coupling 72 but by the piston rods 73. At this time, the respective springs 72*a*, 72*b* and 72*c* of the spring coupling 72 are applied with attraction force or distortion stress, so that the reaction force which is generated by the swivel plate member 80 when the cylinder block 60 begins to rotate, is compensated by the attraction force or the distortion stress.

The motion of the compressor parts as above is carried out simultaneously with the input of the power, and the six pistons 64 carry out the exhaust stroke selectively while rotating together with the cylinder block 60 and simultaneously reciprocate respectively. In a stroke distance of the pistons 64, connection points between the swivel plate member 80 and the piston rods 73 are equal to a distance that the swivel plate moves in the driving shaft direction in the swing motion, which may be represented by 2R sin(K0), wherein R represents a distance from a center of the driven shaft 7 to the connection points between the swivel plate member 80 and the piston rods 73, and K0 represent an inclination angle of the driving shaft 10 and the driven shaft 7.

The flow of the gas in the compressor will be explained below.

First, the gas passes through the external filter (not shown) and is introduced into the intake tube 21 of the gas guide, at which point it circulates in the crank chamber 70 and is introduced into the cylinder bores 61 in the embodiments of FIG. 1 and FIG. 6, while it is directly introduced into the cylinder bores 61 in the embodiment of FIG. 7. As shown in FIG. 1, the gas circulation path for the case in which the gas is introduced after circulation is explained below in detail.

The gas introduced via the intake tube 21 of the gas guide passes through the first intake port 37*a* of the case head, the side port 37*b*, the crank chamber 70, the block chamber 63, the shaft chamber 15, the axial port 16, the side port 38*b*, the intake valve hole 51*a* of the valve plate and the gas holes 14 in sequence and it is then introduced into the cylinder bores 61. An object of the introduction of the intake gas after circulation in the crank chamber 70 instead of directly introducing it into the cylinder bores 61 is to buffer noise caused by residual pressure that may remain in the cylinder bores 61 after the compression and exhaust strokes, as the gas introduced into the crank chamber 70 at a low pressure induces an explosion, which is generated at an instant that gasses of different pressure are mixed, and in the sealed space, that is, in the crank chamber 70, the noise due to the mixing of gases having different pressures is muffled.

The gas introduced into the cylinder bores 61 is compressed while the cylinder block 60 and the pistons 64 rotate, and is discharged selectively according to a pressure of the compression tank via the respective exhaust valve holes 52*a*, 53*a*, 54*a* and 54*b* of the valve plate and the respective exhaust ports 41, 42, 43*a* and 43*b* of the case head at an instant when the gas holes 14 of the cylinder head respectively meet the first to third exhaust valve grooves 52 to 54 of the valve plate, in sequence. The discharged gases are channeled to the exhaust manifold 24 of the gas guide member and are discharged via the exhaust tube 22.

Friction heat, which is generated by friction between the respective parts in the operation of the compressor, may be cooled by a below-mentioned manner.

In the case that lubrication oil is used in the embodiment of FIG. 7, the compressor is operated under a state whereby the lubrication oil is added to the crank chamber 70 until the blades 84 of the swivel plate member are immersed in the lubrication oil. In the above compressor, the blades 84 of the rotating swivel plate scatter the lubrication oil onto inner walls of the crank chamber 70 and simultaneously the heat emission fins 67 of the cylinder block stir the lubrication oil remaining in the sump. Therefore, the scattered lubrication oil is supplied to each of the operating parts and simultaneously cools the friction heat generated by the friction of the parts. At this time, if the lubrication oil is partially atomized and becomes an oil-vapor state, the oil-vapor is discharged to the outside of the compressor via the through hole 15*a* of the driving shaft. Further, the compression heat generated in the cylinder bores 61 and emitted toward the block chamber 63 is also cooled by the vortex flow of the gas formed in the crank chamber 70.

In case that the compressor is operated without using the lubrication oil, the compressor is combined in a power transmission structure in which the friction parts may be minimized. In the case of the compressor, the gas introduced into the crank chamber 70 circulates while forming the vortex flow in the chamber, so that the circulating gas itself serves as a cooling medium.

Even though the cooling operation in the crank chamber 70 is explained in the above, the compressor according to the present invention cools the outside of the case 1 as well as the inside of the compressor in an air or liquid cooling manner. The air-cooling is carried out by an air fan, with radial heat emission fins 31 formed on the case head radially with respect to the driving shaft and heat emission fins 9 formed on the case in parallel with the driving shaft. That is, the air fan is mounted to the motor (not shown) which is positioned in front of the driving shaft for generating wind toward the case 1, so that the wind flows along the heat emission fins 31 and 9 outside the case and cools the outside of the compressor. The liquid cooling is carried out by coolant supplied toward the intake hole 90*a* of a cooling chamber 8 between the case 1 and the cooling case 90, which flows along the spiral heat emission fins 9*a* and is discharged via the discharge hole 90*b* after circulating over the outer peripheral surface of the case 1.

The pistons 64 which rotate together with the cylinder block 60 are applied with centrifugal force in a direction such that a radius increases with respect to the driving shaft 10. In order to compensate the centrifugal force applied to the pistons, as shown in FIG. 7, the plate spring 85 is mounted to the piston rods 73, thereby compensating the centrifugal force applied to the pistons 64 that are in motion.

Now, the compression and exhaust strokes carried out in the compressor according to the present invention will be described in more detail. FIGS. 9A and 9B show intake, compression and exhaust characteristics when the respective valve grooves 51 to 54 meet the respective gas holes 14 of the cylinder head 13 in the process of reciprocation of the pistons 64.

In FIG. 9A, reference symbol T represents a position in which the piston 64 is located at top dead center, and B represents a position in which the piston 64 is located at bottom dead center. Reference symbol K represents an angle that the gas holes 14 of the cylinder head are rotated around the valve plate 50. In FIG. 9A, if the gas holes 14 rotate in the counterclockwise direction around the valve plate 50, a section in which K=0°~180° corresponds to the intake stroke section of the piston travel and a section in which K=180°~360° corresponds to the compression and exhaust stroke section of the piston travel.

In section S1 in which the gas holes 14 rotate from top dead center T to a position K1 immediately before meeting the intake valve groove 51, the partial compressed gas which is not exhausted but remains in the cylinder bores 61 is expanded. In section S2, the gas holes 14 pass through the intake valve groove 51 for intake of the gas. From a position K2 to the bottom dead center B position at K3, the valve plate 50 closes the gas holes 14 for preparing for compression. R1 represents a section where the gas holes 14 move to a position K4 as they are being closed, wherein the intake gas is primarily compressed. E1 is a section where the gas holes 14 pass the first exhaust valve groove 52 and primarily exhaust the primarily compressed gas. R2 represents a section in which the gas holes 14 move to a position K6 of being closed again, wherein the primarily compressed gas is secondarily compressed. E2 is a section in which the gas holes 14 pass the second exhaust valve groove 53 and secondarily exhaust the secondarily compressed gas. R3 is a section in which the gas holes 14 are closed again and they move to a position K8, wherein a tertiary compression is carried out on the secondarily compressed gas. E3 is a section in which the gas holes 14 pass the third exhaust valve groove 54 for carrying out a third exhaust of the tertiarily compressed gas. From K9 to K10, the valve plate 50 closes the gas holes 14 again, and the pistons compress the gas up to top dead center T position and prepare for the next intake stroke.

The significant characteristics of the present invention lie on the compression and exhaust strokes. In the exhaust stroke, the exhaust valve grooves act as the exhaust stroke section when the pressure of the exhaust manifold 24 is low but as the compression stroke section when the pressure of the exhaust manifold 24 is high. That is, even though the gas holes 14 meet the first to third exhaust valve grooves 52 to 54 in the exhaust sections E1 to E3, the compressed gas may be discharged via the exhaust valve grooves 52 to 54 only when the pressure of the compressed gas is higher than the internal pressure of the exhaust manifold 24. If the pressure of the gas compressed in the cylinder bores 61 is lower than the internal pressure of the exhaust manifold 24, the check valves 46 mounted in the respective exhaust ports become closed, so that backflow from the exhaust manifold 24 to the cylinder bores 61 may be prevented and the above sections serve as the compression stroke sections instead of the exhaust stroke sections.

FIG. 9B shows a pressure P of the gas that may be obtained in the cylinder bores 61 for each rotation angle in the case that all the check valves are closed and one of the cylinder bores 61 rotates by one cycle along the valve plate 50.

At this time, the pressure loss due to the check valves and the exhaust channel are ignored for the sake of convenience of explanation, and it is assumed that the pressure in the exhaust tube 22 is equal to that in the compression tank. If the pressure in the intake tube 21 is P00 and a pressure when the gas is taken into the cylinder bores 61 and the rotation angle becomes K1 is P0, it is assumed that P00>P0 due to the air friction loss generated in the process of the intake. Then, Ptr represents a rated pressure in the compression tank, and Pmax represents an available maximum pressure that may be obtained in the cylinder bores 61 while all of the check valves are closed. When actually designing a compressor, the rated pressure Ptr in the compression tank is set as shown in FIG. 9B and the stroke distance of the pistons are controlled to keep the available maximum pressure Pmax in the cylinder bores 61 higher than the set rated pressure Ptr. As the rotation angle K of the gas holes 14 becomes K4, the gas pressure in the cylinder bores 61 at a point 4 becomes P4. Subsequently, if the rotation angle of the gas holes 14 becomes K5, K6, K7, K8, and K9 in sequence, the gas pressure becomes P5, P6, P7, P8 and P9 in sequence. Therefore, when designing the compressor according to the present invention, the rated pressure Ptr of the compression tank becomes the pressure between P8 and P9 that may be obtained when the gas holes 14 are positioned to the final exhaust section E3. As shown in the dotted line of FIG. 9B, the position K1 is set to equalize the pressure of the gas remaining in the cylinder bores 61 after the compression and exhaust strokes with the intake pressure P0.

In the case that the compressor according to the present invention is continuously operated on the basis of the intake and compression/exhaust stroke characteristics and the pressure change in the compressor, the compression characteristics of the gas will be explained below with reference to FIG. 10.

FIGS. 10A to 10C show the compression characteristics of the compressor which may be obtained by a single cylinder bore 61, wherein FIG. 10A shows the compression characteristics of the compressor according to the present invention, FIG. 10B shows the compression characteristics of a prior art reciprocating compressor, and FIG. 10C shows the compression characteristics of a prior art rotary slant shaft type compressor.

In the figures, the horizontal axis represents the number of reciprocation stroke of the pistons, which is equal to a rotation number N of the cylinder block 60. First, the compression characteristics as shown in FIG. 10A will be explained in detail. In the case that the pressure Pt of the compression tank as shown by points D corresponds to the pressures between point P4 and point P5 which represent the rotation positions K4 and K5 of FIG. 9A, the pressure in the cylinder bores 61 changes from point 3, point 4, point 4D, point 5, point 6, point 7, point 8 and point 9 in sequence. That is, the compression is carried out from the initial pressure P0 to the point 4 and the compression is preceded by the point 4D under the state that the check valve 46 in the first exhaust port 41 is closed. However, passing the point 4D, the check valve 46 in the first exhaust port 41 is opened and the same pressure is continued to the point 5. Further, from the point 5 to the point 6, the gas holes 14 passing through the section R2 of FIG. 9A are closed, thereby proceeding with the compression. Next, at the point 6 where the secondary exhaust section E2 begins, the pressure in the cylinder bores 61 becomes higher than the pressure of the point D which represents the pressure of the compression tank, so that the check valve 46 in the secondary exhaust valve 42 opens and the pressure is temporarily decreased by the point 7 where the secondary exhaust procedure E2 is finished. Next, from the point 7 to the point 8, the gas holes 14 are closed again and the section R3 of FIG. 9A is passed, thereby proceeding with the compression again. At the point 8 where the third exhaust section E3 begins, the pressure in the cylinder bores 61 becomes higher than the pressure in the compression tank, so that the check valve 46 in the third exhaust port 43 is opened and the pressure decreases to the pressure of the point D by the point 9 where the third exhaust procedure E2 finishes.

In the above procedure, if the pressure P of the cylinder bore is lower than the pressure Pt of the compression tank as shown by the point D, the check valve 46 remains closed, while it remains open if the pressure P of the cylinder bore is higher than the pressure pt of the compression tank. The reference symbol D in FIG. 10A represents a position where the check valve 46 opens. Therefore, as the number of rotations of the compressor becomes larger, the pressure D of the compression tank becomes higher and the pressure discharged from the cylinder bore 61 to the compression tank is changed from the point 4 to the point 9 as shown by a dotted line of FIG. 10A.

On the other hand, if the compressor is operated under a state such that the auxiliary exhaust tube 26 is connected to the auxiliary intake tube 25 while the compressor is continuously operating, that is, the inside of the cylinder bore 61 is not applied with any compression load, which is the loadless operation state, the compression characteristics of such a compressor are represented as in the right part of FIG. 10A. In this case, a certain pressure loss is generated during intake of outside gas having the pressure P00 into the cylinder bores 61. Considering such a pressure loss, the pressure in the cylinder bores 61 becomes P0, and this pressure is to be the pressure at the point 3. If the compression stroke is proceeded under the loadless operation state, a pressure curve of the cylinder bores 61 has partial compression sections from the point 3 to the point 4, from the point 5 to the point 6, and from the point 7 to the point 8. However, the pressure in the cylinder bores finally becomes equal to the pressure P00 of the outside gas to be inhaled, since the compression and exhaust strokes are carried out while all the check valves 46 are opened.

Now, the compression characteristics of the prior reciprocation type compressor and the prior art slant shaft type compressor will be described in more detail for a comparison with the compression characteristics of the compressor according to the present invention.

Referring to FIG. 10B, the prior art reciprocation type compressor is initiated to operate under the state that the pressure at the point D which represents the pressure Pt of the compression tank is lower than the rated pressure Ptr, the pressure of gas to be compressed in the cylinder as shown by a point B becomes higher than the pressure of the compression tank before the piston reaches top dead center, so that the exhaust valve is opened immediately and the gas is discharged. That is, if the pressure P of a cylinder chamber is lower than the pressure D of the compression tank in the gas compression stroke, the compression continues. If the pressures become equal, an exhaust valve opens for carrying out the exhaust. Therefore, as the number of compressions increases, that is, as the pressure of the compression tank becomes higher, the position of the point B where the compression stroke is finished for each rotation becomes higher. Further, in the case of loadless operation, the exhaust valve is opened at a time point H when the pressure of the exhaust tube becomes P00, as shown in the right part of the compression characteristics curve of FIG. 10B.

In the case of the prior art rotary slant shaft compressor as shown in FIG. 10C, the gas in the cylinder chamber is always compressed up to the point B, it is exhausted when the point B is higher than the point D which represents the pressure of the compression tank, and it continues compression if lower. Even in the case of loadless operation, the gas is compressed up to the point H and then the pressure of the gas is immediately lowered to the pressure P00 of the outside gas to be inhaled.

Figure 10:
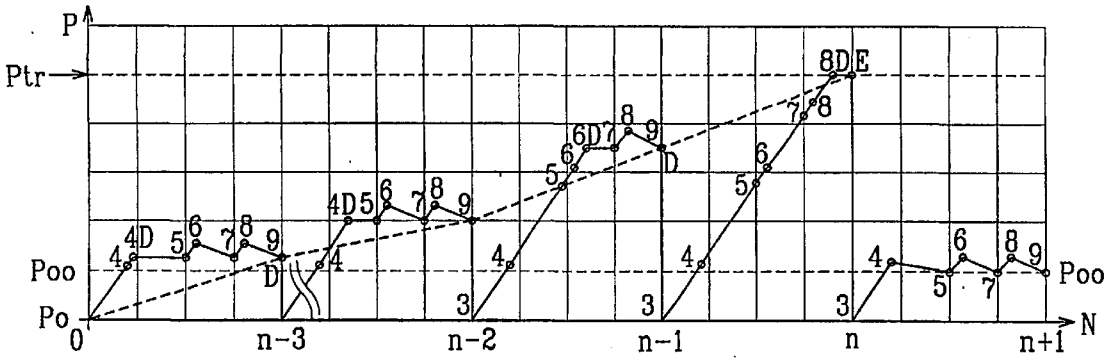
FIG. 10A is a view for explaining the gas compression characteristics when the gas compressor is operating.
FIG. 10B is a view for explaining gas compression characteristics when a prior art reciprocation type compressor is operating.
FIG. 10C is a view for explaining gas compression characteristics when a prior art slant shaft type gas compressor is operating.
Figure 10:
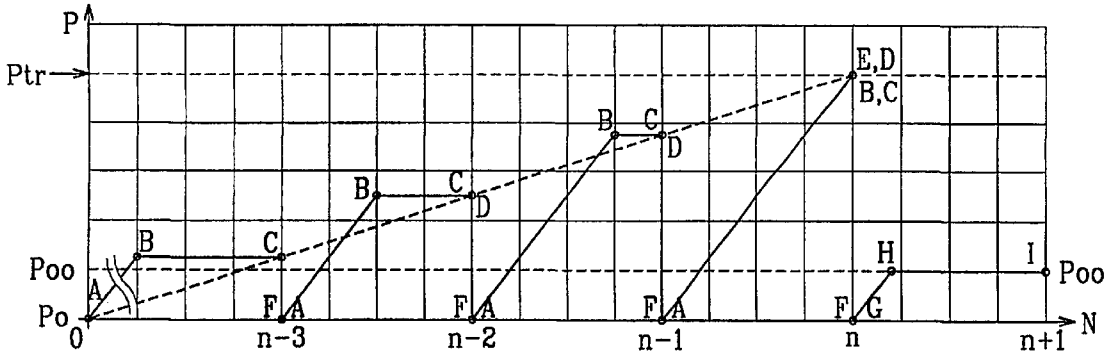
Figure 10:
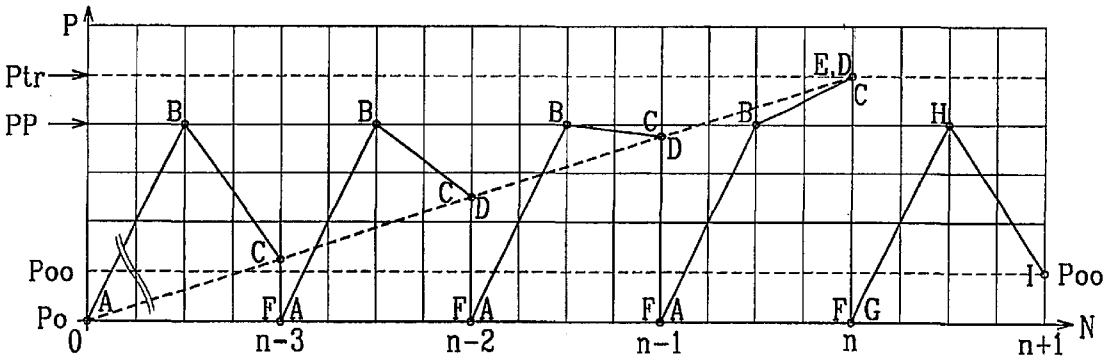

As shown in FIG. 10, if the operation of the compressor is changed to loadless operation at the point where the pressure of the compression tank reaches the rated pressure Ptr during the operation of the compressor, the energy efficiency may be improved. Therefore, a total load amount of the compressor that is required for the gas compression is the sum of polygonal areas formed by the point 3 to the point 9 or the points A, B, C and F for each revolution. The total load amount of the compressor is proportional to the total energy amount that is required for driving the compressor.

According to the compressor of the present invention, the total energy consumption required for compression is similar to that of the prior art reciprocating compressor as show in FIG. 10B, but much smaller than that of the prior art slant shaft type compressor as shown in FIG. 10C.

Therefore, the compressor according to the present invention has higher energy efficiency in comparison with the prior art slant shaft type compressor. In particular, even in the case of loadless operation, the compressor of the present invention exhibits energy consumption that is noticeably smaller than the prior art slant shaft type compressor.

On the other hand, noise, which is generated in the compressor, becomes larger as a difference of pressure between the inside of the cylinder and the inside of the compression tank becomes larger. The prior art slant shaft type compressor, as shown in FIG. 10C, exhibits a large pressure difference between the point B and the point D, while the compressor of the present invention, as shown in FIG. 10A, exhibits a small pressure difference between the point D and the sections from the point 5 to the point 6 and from the point 7 to the point 8. This result shows that there is a very small pressure difference between the compressed gas in the cylinder and the compressed gas in the compression tank, so that the explosion generated when gasses of different pressures mix is very slight. Therefore, the gas compressors according to the embodiments as shown in FIG. 1, FIG. 6 and FIG. 7 have an advantage in that they exhibit little noise.

Considering that the compression load applied to the cylinder bores 61 are equal to the axial force load applied to the driving shaft 10, the compressor of the present invention, as shown in FIG. 10, exhibits a very small change of the compression load per unit time period in comparison with the prior art slant shaft type compressor. Therefore, according to the compressor of the present invention, it is possible to increase the durability of the bearings which support the swivel plate 80 which receives the influence of the variable load directly, as well as the bearings connected to the driving shaft 10.

As described hereinabove, the compressor according to the present invention may carry out the exhaust stroke selectively according to the pressure of the compression tank, and it may be designed in the structure such that the gas to be introduced into the cylinder bores is taken into the cylinder bores directly or after circulation toward the crank chamber for obtaining the following effects.

First, the compressor may be operated quietly by reducing the noise source aerodynamically.

Second, the energy efficiency is maximized by minimizing the power required for the gas compression.

Third, the durability of the compressor is improved by reducing the change of the compression load per unit time period.

Fourth, loadless operation of the compressor is possible with high efficiency.

Fifth, the gas compression efficiency and the durability of the compressor may be improved by circulating coolant around the compressor and emitting the heat generated by the mechanical friction and the air compression by using cooling lubrication oil.

Sixth, the heat generation may be restrained and the lifespan of the compressor may be extended by compensating the centrifugal force generated by the rotation of the pistons and reducing the relative frictional force generated on contact surfaces in the cylinder, and Seventh, the assembling productivity of the compressor may be improved by simplifying the assembling of the pistons by forming the piston rods as the two-fold type.

It will be apparent to those skilled in the art that various modifications and variations can be made to the device of the present invention without departing from the spirit and scope of the invention. The present invention covers the modifications and variations of this invention provided they come within the scope of the appended claims and their equivalents.

What is claimed is:

1. A rotary slant shaft type gas compressor comprising:

a driving shaft integrally formed with a cylinder head perpendicular to the driving shaft, the cylinder head being formed with a plurality of gas holes on a concentric circle at uniform intervals;

a gas guide member formed with an intake manifold for intake of gas from the outside and an exhaust manifold for discharging gas compressed in cylinder bores to the outside;

a case head member for rotatably supporting the driving shaft formed with at least one intake port for supplying the gas taken in through the intake manifold to the inside of the cylinder bores, and two or more exhaust ports for discharging the gas compressed in the cylinder bores to the exhaust manifold;

a valve plate member fixed on an inner surface of the case head member to contact an outer surface of the cylinder head, and formed with a gas intake valve groove and at least two gas exhaust valve grooves on a periphery on which the gas holes move, the gas intake valve groove supplying the gas taken in through the intake port to the inside of the cylinder bores and the gas exhaust valve grooves discharging the gas compressed in the cylinder bores to the exhaust ports;

a cylinder block formed with a plurality of cylinder bores in parallel with the driving shaft and having a surface integrally coupled with the cylinder head, and having an opposite surface slidably inserted with pistons in respective cylinder bores for compressing the intake gas in the respective cylinder bores;

a swivel plate member connected to a center part of the cylinder block with a coupling, and connected to a plurality of pistons via piston rods, for converting a rotation force transmitted from the driving shaft to rectilinear reciprocation motion to be transmitted to the pistons;

a case end plate formed with a slant surface for supporting the swivel plate member; and a case coupled with the case head member and the case end plate for incorporating the cylinder block and the swivel plate member.

2. A rotary slant shaft type gas compressor as claimed in claim 1, wherein the respective exhaust ports of the case head member incorporate respective check valves.

3. A rotary slant shaft type gas compressor as claimed in claim 2, wherein the gas intake valve groove of the valve plate member is formed within a section of 180° of a circumference corresponding to an intake stroke section in which a specific piston moves from top dead center to bottom dead center, and the gas exhaust valve grooves are formed in a remaining 180° section of the circumference corresponding to a compression stroke section in which the piston moves from bottom dead center to top dead center.

4. A rotary slant shaft type gas compressor as claimed in claim 3, wherein the gas intake valve groove and the gas exhaust valve grooves of the valve plate member are formed apart from one another by at least a certain distance, that is, a length (VL) of a partition wall, which is larger than a diameter of the gas holes of the cylinder head.

5. A rotary slant shaft type gas compressor as claimed in claim 4, wherein each length of the gas exhaust valve grooves of the valve plate member is shorter than a distance between the gas holes.

6. A rotary slant shaft type gas compressor as claimed in claim 5, wherein each width of the gas valve grooves of the valve plate member is formed the same as or larger than the diameter of the gas holes.

7. A rotary slant shaft type gas compressor as claimed in claim 6, wherein at least one of the gas exhaust valve grooves of the valve plate member is formed with a groove width smaller than the diameter of the gas holes.

8. A rotary slant shaft type gas compressor as claimed in claim 5, wherein the case head member and the driving shaft are formed with a circulation circuit for introducing the gas introduced from the intake manifold to the cylinder bores via a sealed crank chamber formed inside the case.

9. A rotary slant shaft type gas compressor as claimed in claim 8, wherein the circulation circuit is formed with at least one intake channel communicated from the intake manifold of the case head member to the crank chamber and at least one sub-intake channel communicated from the crank chamber to the cylinder bores via a cylinder block chamber, and the driving shaft is partially hollow in an axial direction of the driving shaft, wherein the hollow part is formed with at least one axial port perpendicular to the driving shaft.

10. A rotary slant shaft type gas compressor as claimed in claim 9, wherein the hollow part in the driving shaft or the cylinder block chamber is formed with at least one liquid introduction preventing shoulder.

11. A rotary slant shaft type gas compressor as claimed in claim 10, further comprising a tension ring and a ring-shaped plate spring inserted between the inner surface of the case head member and the valve plate member.

12. A rotary slant shaft type gas compressor as claimed in claim 11, wherein an outer surface of the case is attached with a cooling case surrounding the case, the cooling case being formed with a coolant intake hole and a coolant discharge hole, and wherein the case is formed with spiral heat-emission fins outside the case.

13. A rotary slant shaft type gas compressor as claimed in claim 12, wherein an outer peripheral surface of the swivel plate member is formed with a plurality of blades.

14. A rotary slant shaft type gas compressor as claimed in claim 13, wherein an outer surface of the case head member is formed with heat emission fins projecting radially with respect to the driving shaft and an outer surface of the case is formed with heat emission fins in parallel with the driving shaft.

15. A rotary slant shaft type gas compressor as claimed in claim 14, wherein the gas guide member is formed with an auxiliary intake tube and an auxiliary exhaust tube that connect an intake tube communicated with the intake manifold to an exhaust tube communicated with the exhaust manifold.

16. A rotary slant shaft type gas compressor as claimed in claim 1, wherein the coupling that connects the cylinder block to the swivel plate member comprises a universal coupling or a bevel gear.

17. A rotary slant shaft type gas compressor as claimed in claim 16, wherein a piston rod that connects a piston to the swivel plate member comprises a universal coupling, a two-fold crank or an extension rod.

18. A rotary slant shaft type gas compressor as claimed in claim 17, wherein the extension rod is formed of a male and a female bolt, wherein the stroke clearance of the piston is controlled by using a lock nut coupled with an outside of the male bolt.

19. A rotary slant shaft type gas compressor as claimed in claim 18, wherein a plate spring is mounted outside the extension rod.

20. A rotary slant shaft type gas compressor as claimed in claim 1, wherein the coupling that connects the cylinder block to the swivel plate member comprises a spring coupling.

21. A rotary slant shaft type gas compressor as claimed in claim 20, wherein the piston rod that connects the piston to the swivel plate member comprises a two-fold crank.

22. A rotary slant shaft type gas compressor as claimed in claim 21, wherein the spring coupling is connected between the cylinder block and the swivel plate member in the same direction as the rotation of the cylinder block and the piston rod for applying attraction force or distortion stress.

* * * * *